US008689716B2

(12) United States Patent
Gai et al.

(10) Patent No.: US 8,689,716 B2
(45) Date of Patent: Apr. 8, 2014

(54) SERVO-ASSISTED STEERING DEVICE

(75) Inventors: Marcella Gai, Genoa (IT); Enrico Pagani, Genoa (IT)

(73) Assignee: ULTRAFLEX S.p.A., Casella (GE) (IT)

( * ) Notice: Subject to any disclaimer, the term of this patent is extended or adjusted under 35 U.S.C. 154(b) by 65 days.

(21) Appl. No.: 13/396,951

(22) Filed: Feb. 15, 2012

(65) Prior Publication Data

US 2012/0204777 A1 Aug. 16, 2012

(30) Foreign Application Priority Data

Feb. 16, 2011 (IT) ..... GE2011A0017

(51) Int. Cl.
*B63H 25/22* (2006.01)

(52) U.S. Cl.
USPC ..... 114/150; 114/144 E

(58) Field of Classification Search
USPC ..... 114/150, 144, 144 E
See application file for complete search history.

(56) References Cited

U.S. PATENT DOCUMENTS

| | | | | |
|---|---|---|---|---|
| 4,366,768 | A * | 1/1983 | Kulischenko et al. | 114/144 E |
| 4,771,846 | A * | 9/1988 | Venable et al. | 180/422 |
| 2003/0033969 | A1 * | 2/2003 | Doetsch | 114/150 |
| 2012/0204777 | A1 * | 8/2012 | Gai et al. | 114/150 |

FOREIGN PATENT DOCUMENTS

| | | |
|---|---|---|
| GB | 2239488 | 7/1991 |

* cited by examiner

*Primary Examiner* — Lars A Olson
*Assistant Examiner* — Jovon Hayes
(74) *Attorney, Agent, or Firm* — Themis Law

(57) ABSTRACT

A servo-assisted steering device for vehicles includes a manual control member connected to a shaft driving a pressurized control fluid supplying and conveying unit, which has at least two fluid conveying lines connected to one of two chambers of one or more steering actuators. A hydraulic power unit is connected to the supplying and conveying unit and includes a reservoir for the hydraulic fluid and powered pumping means, which are driven by an electric motor and which are connected to the fluid supplying/conveying circuit to supply the pressurized fluid alternately to either one or the other of the two chambers of the actuator (or actuators) depending on the rotational direction of the control member. The electric motor is energized and/or de-energized upon operation of the control member, causing the pumping means to increase the amount of pumped fluid and reduce resistance upon steering the manual control means.

22 Claims, 2 Drawing Sheets

SERVO-ASSISTED STEERING DEVICE

FIELD OF THE INVENTION

The present invention relates to a servo-assisted steering device for vehicles, in particular for boats or the like. Such device is composed of a manual control member, such as a steering wheel or the like, connected to a shaft driving a pressurized control fluid supplying and conveying unit, such as a pump or the like, for manually driving it when the control member is rotated. The supplying and conveying unit has at least two fluid conveying lines through which the fluid flows in or out depending on the rotational direction of the driving shaft. The conveying lines are connected to one of the two chambers respectively of one or more steering actuators, such as a double acting hydraulic cylinder or the like, by means of hydraulic pipes, for supplying a pressurized fluid alternately to either one or the other of the two chambers of the actuator or actuators depending on the rotational direction of the control member.

A hydraulic power unit is connected to the supplying and conveying unit and includes at least a reservoir for the hydraulic fluid, and powered pumping means which are driven by at least one electric motor and by electrical connection means of the electric motor. The pumping means are also connected to the fluid supplying/conveying circuit for supplying the pressurized fluid, alternately to either one or the other of the two chambers of the actuator or actuators, depending on the rotational direction of the control member and correspondingly to the rotational direction of the control member.

The electric motor is energized and/or de-energized upon operation of the control member, such that the pumping means increase the amount of pumped fluid and increase the pressure exerted by the supplying and conveying unit in order to reduce the resistance when steering the manual control means.

BACKGROUND OF THE INVENTION

There are several types of servo-assisted steering devices and systems known in the prior art and they all are structured to reduce the resistance of the control member when manoeuvring, regardless of the type of vehicle. The manoeuvring is enhanced by increasing the steering force acting on the control means, which generally is achieved by energizing an electric motor that for example can act in combination with a pump, in order to increase the pressure of the fluid flowing into the steering circuit.

The use of an electric motor within steering devices has the drawback of increasing the electric energy consumption that, if reaching high levels, affects the vehicle battery too much, causing the charge thereof to be exhausted.

This drawback is particularly significant above all for boats, since the exhaustion of the battery charge causes the boat to stop, thus running the risk of remaining stopped during voyage, far away from the coast and in uncomfortable conditions.

This drawback is an important problem of steering devices, since an excessive consumption of the battery charge does not allow vehicles to be started and/or to be normally operated, above all the ones where the electronic part has a high importance, such to particularly affect the battery charge.

In particular, if specific arrangements are not provided, when the motor of the vehicle reduces the supplied power and does not constantly recharge the battery, the absorption of electric energy by the electric motor remains high, causing the energy stored in the battery to be needed.

Current systems for reducing, or for monitoring, electric energy consumption of the electric motor have been developed.

A first solution is to turn off the electric motor anytime the control member is not used for steering. If the steering wheel is not moved, then a control unit turns off the electric motor such that it does not consume. However, turning on and off the electric motor causes an unpleasant sensation for the driver, since it does not allow a smooth driving, but the steering wheel has a "jerkily" behavior. Moreover, the turning on and off of the electric motor continuously in continuation leads to critical issues in the operation both from the electronic and mechanical standpoints.

A second solution is to keep the fluid within the steering circuit always under a constant pressure such to continuously provide the necessary increase in steering force, both whether the steering wheel is moved or not moved. Obviously this solution provides a smooth and constant driving sensation, but it has high electric energy consumptions. In order to reduce the high consumptions this solution reduces the revolutions of the electric motor each time the steering wheel is not moved, but nevertheless the absorption level remains high, and is excessive for the battery charge. Moreover, when the traveling conditions of the vehicle change in a sudden and continuos manner, the control reducing the revolutions of the electric motor does not have a prompt response, which is necessary to guarantee the correct operation of the system, with the risk of maintaining the number of revolutions of the electric motor always high in order to guarantee the necessary pressure level.

Therefore, there is an unsatisfied need for a servo-assisted steering device, which provides for low energy consumptions, independently of the running of the vehicle and while keeping a rotation and/or movement of the control member and which further provides, for a user, a behavior that is smooth and without jerks or jolts.

SUMMARY OF THE INVENTION

The present invention achieves the above aims by providing a servo-assisted steering device as described hereinbefore, wherein the hydraulic power unit is connected to a control unit, in communication with the electric motor and the control member. The control unit sets the operation of the electric motor according to the rate and/or number of rotations of the control member.

In particular, the control unit sets the electric current consumption of the electric motor according to the rate and/or number of rotations of the control member.

Therefore, the electric motor is not turned on/off by an electronic control unit, but a control unit is provided that detects the movements of the control member and modifies the power supply of the electric motor.

Advantageously, the control unit detects, continuously, the electric current consumption of the electric motor, compares the detected electric current consumption with the rate and/or number of rotations of the control member and sets the operation of the electric motor.

The setting of the operation of the electric motor occurs in such a manner that the electric current consumption of the electric motor corresponds to pumping means that are operated to increase the amount of pumped fluid by increasing the pressure exerted by the supplying and conveying manual unit, in order to reduce the resistance when steering the manual control means.

Therefore, the control unit interprets the rotation of the control member as a request to increase the pressure of the hydraulic fluid inside the steering circuit and translates such request into a corresponding increase in the electric current for supplying the electric motor. Thus, the electric current consumption is always optimized on the basis of the travel conditions of the vehicle, in order to avoid electric current from being wasted and consumed excessively.

Advantageously, an electric motor is used with a low number of revolutions with respect to the motors currently on the market and with a high torque, preferably an electric motor with a number of revolutions less than 1550 revolutions/minute.

The use of the motor provides for lower electric current absorptions to be achieved and at the same time provides for reduced noises and vibrations.

The noise drawback is of particular importance in boats where an excessive noise level is particularly annoying for the user. A reduced number of revolutions allows vibrations to be significantly reduced in addition to allow the noise to be reduced.

Such arrangements allow the hydraulic power unit to be arranged in a boat without using a case, therefore solving also possible overheating drawbacks of the electric motor and providing for the electric motor to be ventilated to a greater extent.

Advantageously, an oil having a low viscosity may be used as the fluid within the steering circuit, in particular fluids having a viscosity lower than 30 cSt may be used.

The electric motor can have two, three or more operating conditions, different one from the other on the basis of the number of revolutions of the electric motor and/or of the fluid amount required by the control device, corresponding to the typical mean operating modes of the steering means in two, three or more travel conditions. Such operating conditions are settable alternating one with other, namely an operating condition is activated by excluding the one in use.

Preferably the operating conditions can be activated through a manual input by an operator.

An operator can set the different operating conditions through an input unit that obviously must communicate with the electric motor and modify the predetermined operating settings characterizing the different operating conditions.

Each operating condition has predetermined settings, for example, with reference to the number of revolutions of the electric motor, the required power or the pressure required within the steering circuit, which change depending on the travel of the vehicle. Therefore, by setting through the input unit a particular operating condition, a limit to the power of the power supply signal of the electric motor is put which is the cause of a specific number of revolutions, of the power of the electric motor and consequently of the fluid pressure within the steering circuit.

Advantageously it is possible to provide even the control unit to set the transition from one operating condition to another one.

Moreover since each operating condition is the expression of the number of revolutions of the electric motor and therefore of the amount of absorbed energy, preferably the control unit automatically sets the selection of the best operating condition on the basis of the travel conditions such to optimize the consumptions of the energy absorbed by the electric motor.

The control unit detects the operating condition in which the electric motor is, that is the control unit detects the power generated by the electric motor, and it verifies that the generated power is enough to produce, through the pumping means, a suitable pressure increase, on the basis of the rate and/or number of rotations of the control member in order to make the necessary steering movements.

According to a possible embodiment in combination with the control unit it is possible to provide means measuring the current absorbed by the electric motor which detect the operating condition.

Such means can be for example composed of one or more sensors measuring the amount of current absorbed by the electric motor and sending to the control unit a datum indicative of the value of the absorbed current. For each operating conditions a predetermined threshold of the value of absorbed current and/or a predetermined range of values of the current absorbed by the motor is stored.

Such threshold values or such value ranges can be stored within the control unit or into an external storage unit communicating with the control unit, such that the control unit compares such values with the one received from the current measuring means in order to automatically modify the power limit value of the power signal fed to the electric motor, when the measured current value exceeds the threshold or it does not fall within the range of stored values.

Therefore an operating condition of the electric motor is manually set and, when the value of the current absorbed by it exceeds the values set for the selected operating mode, the control unit automatically sets the operating condition of the electric motor having the values within which the measured current value falls.

Since the absorbed current is continuously detected, the control unit advantageously restores the electric motor to the operating condition manually previously set, after a specific period of time, during such period of time the value of the absorbed current has returned back and has remained within the limits of the values provided for the manually set operating condition.

Such time range is settable and can change depending on the different travel conditions and it further allows the electric current consumptions to be reduced, since the operator is not involved in changing the operating condition once the vehicle returns back to the manually set condition, all this occurs automatically such to optimize the consumptions upon the request by the operator to increase the pressure.

Preferably the servo-assisted steering device object of the present invention provides three different operating conditions of which a first condition, a second condition and a third condition.

Therefore each operating condition provides different values of the current absorbed by the electric motor and consequently the number of revolutions thereof will be adjusted accordingly.

Such absorption values are obviously based on the necessary pressure increase in the steering circuit necessary to carry out specific manoeuvres during the different travel conditions.

For example in the case of boats it is possible to provide a first operating condition identified by a preferably constant cruising speed, a second operating condition having a low speed travel, while the third operating condition can denote a mode wherein sudden and sequential manoeuvring operations are made.

In the first operating condition, there are no particular electric energy consumption problems since the propelling motor of the boat allows the battery to be constantly recharged such to allow the electric motor to run at speeds that allow the pumping means to set such a pressure level in the steering circuit to carry out any manoeuvres.

Moreover in general when sealing at cruising speeds sudden manoeuvres are not required and generally the route is corrected with manoeuvres that do not lead to excessive rotations of the control member.

In the second operating condition, the level of the electric current absorbed by the electric motor must be low for preventing the battery and the discharge thereof from being affected, since low speeds do not allow the propelling motor to correctly charge it.

For example the second operating condition is typical of boats when are intended for fishing. By travelling at a low speed, the propelling motor in idle mode charges the battery for low current values ranging from 25 to 15 Ampere, too few for supplying servo-assisted steering systems known in the prior art that arrive to consume higher values, about 60 Ampere.

By using the steering systems known in the prior art, as soon as the operator desires to make a manoeuvre the whole system has a fluid shortage, the servo-assistance to steering comes to fail and the electric motor runs the risk of stalling with the consequent heating and potential damage thereof.

In the device object of the present invention the control unit, according to the modes described above, detects a higher pressure request, therefore it temporarily sets the operation of the electric motor such to increase the number of revolutions to guarantee the greatest servo-assistance, that is the maximum pressure level that can be obtained for performing any manoeuvres.

It happens likewise in the third operating condition. The third operating condition provides a rapid sequence of manoeuvres, therefore for most of the time the operation of the electric motor is set such to increase the number of revolutions to guarantee the greatest servo-assistance that is the maximum pressure level that can be obtained.

Even if in the first operating condition a servo-assistance increase is requested, the control unit acts on the operation of the electric motor in order to meet such request.

According to an improvement of the device of the present invention, if the user manually selects the third operating condition, it is possible for the control unit to set the electric motor such that it runs with the lowest number of revolutions, if it does not receive for a specific period of time by the control member, requests for increasing the servo-assistance.

In combination with the automatic use it is possible to manually control the control unit, in order to manually control the different operating modes of the electric motor.

In combination with such characteristic it is possible to provide operating/disabling means for the control unit, which are preferably composed of at least a push button switch, in connection with the control unit and with the power supply circuit of the whole steering system. Such push button switch has two conditions, of which an operating condition and a disabling condition, and an electronic control unit such that the control unit is operated or disabled on the basis of the operating/disabling condition of the push button switch.

The operating/disabling condition of the push button switch is defined by the control electronics that control the opening or closing of the power supply circuit and in case of closed power supply circuit it allows the switch to be operated by a manual input.

Advantageously in case of non-power supply the control electronics automatically set the push button switch in the disabling condition even without the manual input.

As described above, in the servo-assisted steering devices known in the prior art, if the battery is not able to meet the electric current needs of the electric motor, it stalls, the temperature increases with the risk of wearing the whole steering device. In order to overcome this problem the servo-assisted steering device object of the present invention provides a monitoring control unit, intended for monitoring the temperature of the electric motor.

The monitoring control unit controls means for opening the power supply circuit of the electric motor, which are set according to a specific temperature value and they close the power supply circuit of the electric motor upon the overcoming of the threshold value, while they open again the power supply circuit as soon as the temperature falls down at a allowable level.

The monitoring control unit preferably is electrically connected to the control unit, such to send a warning signal to the control unit which is thus notified about the impossibility of sending power supply signals to the electric motor and such to wait for a signal restoring the power supply circuit in order to begin again the normal operation.

In order to enhance such characteristic and to further increase the safety level of the whole device object of the present invention it is possible to provide the input unit to be composed of a display, with signalling means which are separate for each provided operating condition and input means for manually setting one of the provided operating conditions.

The manual input means are connected to the control unit for sending the input selecting the operating condition to the control unit and for actuating the signalling means.

If the control unit automatically controls a temporary change of the operating condition of the electric motor, it keeps the means signalling the operating condition corresponding to the operating condition manually set by the setting input means in the activated condition.

According to an embodiment means indicating the temperature of the electric motor and particularly indicating the overcoming of the maximum allowed threshold temperature and actuating the means opening the power supply circuit of the motor are associated to the monitoring control unit.

Thus the operator would be always aware of all the operating parameters of the vehicle.

Then it is possible to provide the control fluid manual supplying and conveying unit to be composed of a hydraulic pump, whose drive shaft is connected to the manual control members, of a hydraulic steering gear to be used when steering road vehicles, or any similar means.

In particular the supplying and conveying unit can be a manually operated piston pump, such as described in SV2005A000011, a manual pump with a driving shaft rotatably fitted into an housing case; a rotor rotatably integral with the driving shaft, having a plurality of axial compression chambers, each one of which housing a piston urged by spring means against a cam track; a distribution cylinder projecting inside a coaxial central hole of the rotor and provided with at least two ducts for the passage of the pressurized fluid, alternately communicating with suction/exhaust ducts of the compression chambers; the distribution cylinder being stationary. The distribution cylinder is made as a separate structural part from the bottom closing the housing case and it is removably secured thereto by means of screw fastening means or the like.

As an alternative the supplying and conveying unit can be a gerotor pump, such as described in the application SV2002A000031, that is such pump is composed of at least an outer rotor and at least an inner rotor. The inner rotor has a plurality of peripheral notches with a curved configuration and identical one another, preferably in the form of circular sector, and forming projecting tooth-like elements therebetween. The outer rotor has a peripheral wall with a configuration complementary to the notches and to the teeth of the inner rotor, forming a plurality of notches complementary to the tooth elements of the inner rotor. The outer rotor has a number of notches for the tooth elements of the inner rotor equal to the number of the tooth elements of the inner rotor plus at least a further notch. The inner rotor rotates inside the outer rotor about an axis parallel to that of the outer rotor but radially offset with respect to it and it rotatably drives the outer rotor that rotates into a circular housing seat The present invention further relates to a servo-assisted steering device for vehicles, in particular for boats or the like, composed of a manual control member, such as a steering wheel or the like connected to the shaft driving a pressurized control fluid supplying and conveying unit, such as a pump or the like, for manually driving it when the control member is rotated and which supplying and conveying unit has at least two fluid conveying lines through which the fluid flows in or out depending on the rotational direction of the driving shaft and which are in turn connected to one of the two chambers respectively of one or more steering actuators, such as a double acting hydraulic cylinder or the like, by means of hydraulic pipes, for supplying the pressurized fluid alternately to either one or the other of the two chambers of the actuator or actuators depending on the rotational direction of the control member.

Moreover there is provided a hydraulic power unit connected to the supplying and conveying unit, which is composed of at least a reservoir for the hydraulic fluid, of powered pumping means which are driven by at least an electric motor and by electrical connection means of the electric motor. The pumping means are also connected to the fluid supplying/conveying circuit for supplying the pressurized fluid alternately to either one or the other of the two chambers of the actuator or actuators depending on the rotational direction of the control member and correspondingly to the rotational direction of the control member.

The electric motor is energized and/or de-energized upon the operation of the control member, such that the pumping means increase the amount of pumped fluid and increase the pressure exerted by the supplying and conveying manual unit in order to reduce the resistance when steering the manual control means. The electric motor of the hydraulic power unit is fed by a voltage ranging from 12 V to 17 V, preferably from 13 V to 16 V.

Moreover advantageously the electric motor of the hydraulic power unit has a current absorption ranging from 0.5 A to 40 A, preferably from 1 A to 35 A.

According to a further embodiment the electric motor of the hydraulic power unit provides a number of revolutions less than 1500 revolutions/minute.

Advantageously the pumping means of the hydraulic power unit provide pressures ranging from 1 bar to 42 bar.

Finally such servo-assisted steering device just described can have one or more of the characteristics previously described, in particular it can be provided in combination with one or more of the characteristics regarding the control unit shown above.

In particular with reference to the operating conditions of the electric motor the following is specified:

during the first operating condition the electric motor is fed with a voltage ranging from 12 V to 17 V, with a current absorption ranging from 1 A to 13 A, it has a number of revolutions less than 1500 revolutions/minute, while the pumping means provide pressures ranging from 2 bar to 19 bar;

during the second operating condition the electric motor is fed with a voltage ranging from 12 V to 17 V, with a current absorption ranging from 0.5 A to 5 A, it has a number of revolutions less than 1500 revolutions/minute, while the pumping means provide pressures ranging from 1 bar to 10 bar;

during the third operating condition the electric motor is fed with a voltage ranging from 12 V to 17 V, with a current absorption ranging from 4 A to 33 A, it has a number of revolutions less than 1500 revolutions/minute, while the pumping means provide pressures ranging from 1 bar to 45 bar.

BRIEF DESCRIPTION OF THE DRAWINGS

These and other characteristics and advantages of the present invention will be clearer from the following description of some embodiments shown in the annexed drawings wherein.

DETAILED DESCRIPTION OF EMBODIMENTS OF THE INVENTION

Detailed descriptions of embodiments of the invention are provided herein. It is to be understood, however, that the present invention may be embodied in various forms. Therefore, the specific details disclosed herein are not to be interpreted as limiting, but rather as a representative basis for teaching one skilled in the art how to employ the present invention in virtually any detailed system, structure, or manner.

Figure 1:
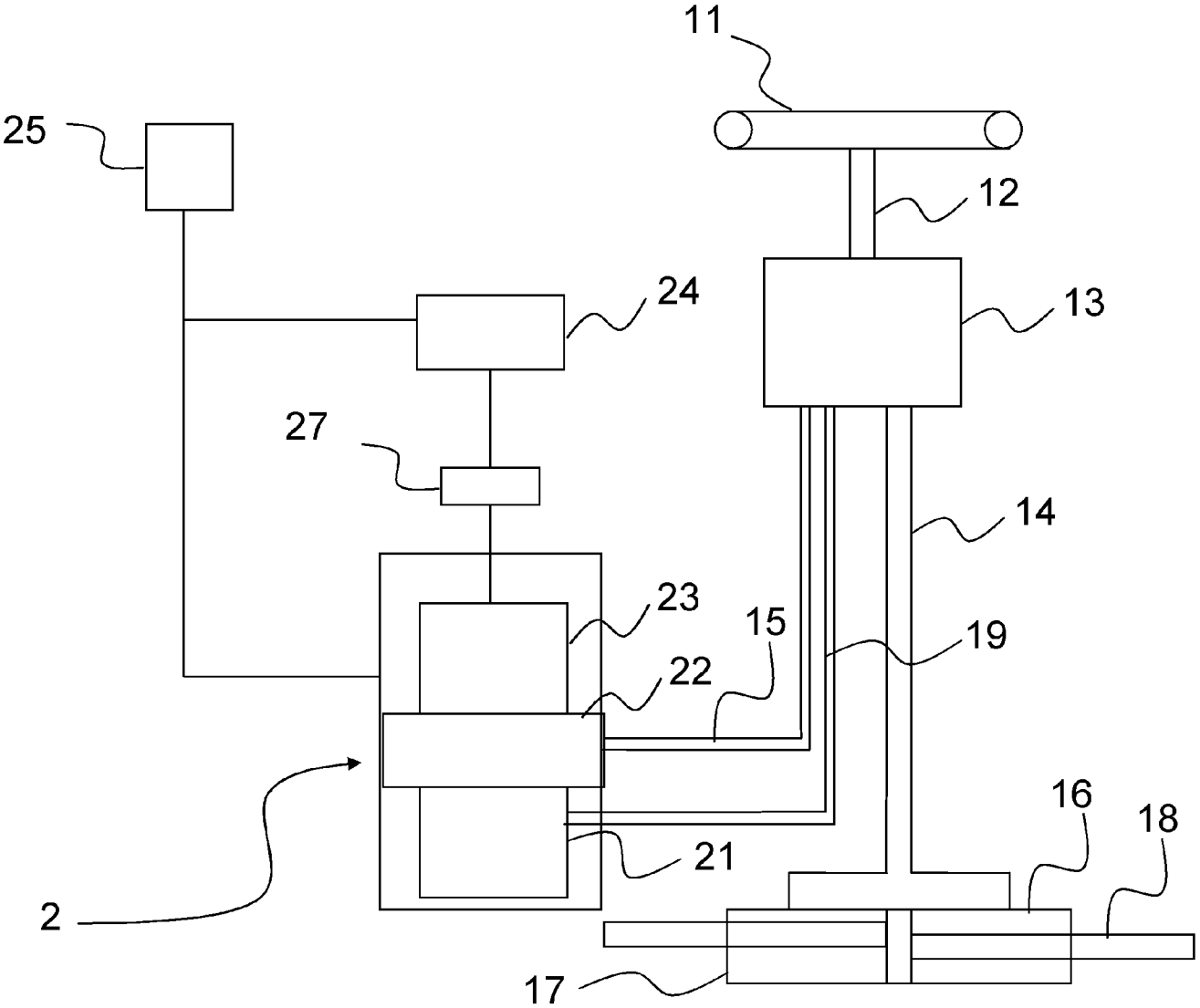
FIG. 1 is a schematic diagram of a possible embodiment of the servo-assisted steering device object of the present invention.

The schematic diagram shown in FIG. 1 shows the servo-assisted steering device composed of a manual control member, such as a steering wheel or the like 11, which is connected to the shaft 12 driving a pressurized control fluid supplying and conveying unit 13 for manually driving it when the control member 11 is rotated.

The supplying and conveying unit 13 has at least two fluid conveying lines through which the fluid flows in or out depending on the rotational direction of the driving shaft 12 and which conveying lines are connected to one of the two chambers 16, 17 respectively of one or more steering actuators 18, such as a double acting hydraulic cylinder, by means of hydraulic pipes 14, for supplying the pressurized fluid alternately to either one or the other of the two chambers 16, 17 of the actuators 18 depending on the rotational direction of the control member 11.

To the supplying and conveying unit 13 there is connected the hydraulic power unit 2 composed of a reservoir 21 holding the fluid, of powered pumping means 22 which are driven by an electric motor 23 and by electrical connection means of the electric motor 23. The hydraulic power unit 2 is connected to the supplying and conveying unit 13 through the hydraulic connection pipes 15 and 19, in particular the pipe 19 puts in communication the supplying and conveying unit 13 with the reservoir 21 of the pressurized fluid, while the pipe 15 puts in communication the unit 13 with the powered pumping means 22.

The pumping means 22 are also connected to the fluid supplying/conveying circuit for supplying the pressurized fluid alternately to either one or the other of the two chambers 16, 17 of the actuators 18 depending on the rotational direction of the control member 11 and correspondingly to the rotational direction thereof.

The rotation of the control member 11 energizes and/or de-energizes the electric motor 23 that in turn operates the pumping means 22 such that they increase the amount of pumped fluid and increase the pressure exerted by the supplying and conveying manual unit 13 in order to reduce the resistance when steering the manual control means 11.

Moreover the hydraulic power unit 2 is connected to a control unit 24, in communication with the electric motor 23 and the control member 11, intended to set the operation of the electric motor 23 depending on the rate and/or number of rotations of the control member 11.

In particular the control unit 24 sets the electric current consumption of the electric motor 23 modifying the number of revolutions and therefore the power supplied depending on the rate and/or number of rotations of the control member 11

The operation of the control unit 24 is such that it detects, continuously, that is instant by instant, the electric current consumption of the electric motor 23, it compares the detected electric current consumption with the rate and/or number of rotations of the control member 11 and it sets the number of revolutions of the electric motor 23, such that the electric current consumption thereof corresponds to the pumping means 22 being operated such to increase the amount of pumped fluid, by increasing the pressure exerted by the supplying and conveying manual unit 13 in order to reduce the resistance when steering the manual control member 11.

The electric motor 23 can have two, three or more operating conditions settable alternatively from one another. Such operating conditions are different from one another depending on the number of revolutions thereof and/or of the amount of fluid required by the control member, correspondingly to the typical mean operating modes of the steering means under the two, three or more different travel conditions.

The operating conditions are manually settable by an operator by means of an input unit 25, connected to the electric motor 23, which thus serves for changing the settings driving the electric motor 23 correspondingly to the number of revolutions thereof, imposing a limit to the power of the power signal, a limit different for each operating condition.

Therefore the input unit 25 acts for initially setting the operating condition at which the electric motor 23 has to run, while the transition from one condition to another one is regulated by the control unit 24. Preferably such transition is automatically controlled by the control unit 24 depending on the rate and/or number of rotations of the control member 11, the operating condition of the electric motor 23 being detected.

With a particular reference to FIG. 1, the control unit 24 receives information about the operating condition of the electric motor 23 by means of its connection to means 27 measuring the absorbed current, which can be composed of sensors that measure the electric current consumption by the electric motor 23.

For each operating condition, a predetermined threshold of the absorbed current value and/or a predetermined value range of the current absorbed by the electric motor 23 is provided and stored, so that each operating condition can be identified on the basis of a level of the absorbed electric current.

Consequently the control unit 24 receives the value of the absorbed current from the measuring means 27 and automatically it modifies the power limit value of the power signal fed to the electric motor 23, when the measured value exceeds the provided threshold or it does not fall within the range of values provided for the operating condition manually set by the operator.

According to the embodiment shown in FIG. 1, the electric motor 23 automatically passes from one operating condition to another operating condition, controlled by the control unit 24. The control unit 24 consequently to the change of the operating condition, restores the motor 23 to the previously manually set operating condition, after a predetermined period of time, during which the value of the absorbed current has returned back and has remained within the value limits provided for the manually set operating condition.

Moreover according to the shown variant embodiment, there are provided three different operating conditions, of which a first condition, a second condition and a third condition.

For example if the vehicle is a boat, three different operating conditions can be defined.

The first operating condition can identify navigation at a preferably constant cruising speed, the second operating condition can identify navigation at low speeds, while the third operating condition can identify a mode wherein sudden and sequential manoeuvring operations are made.

Therefore the three conditions are different each other on the basis of the number of revolutions and the power of the propelling motor, but these three operating conditions refer mainly to an operation of the electric motor 23 and each one identifies different consumption levels of the electric energy absorbed by the electric motor 23.

Therefore if the boat has to travel at a constant cruising speed the operator sets by the input unit 25 the first operating condition of the electric motor 23, similarly it happens for setting the other operating conditions.

During the first operating condition, there are no particular problems of electric energy consumption since the propelling motor of the boat allows the battery to be constantly recharged such to allow the electric motor 23 to run at speeds allowing the pumping means 22 to set such a pressure level inside the steering circuit to perform any manoeuvres.

Moreover in general when sealing at cruising speeds sudden manoeuvres are not required and generally the route is corrected with manoeuvres that do not involve excessive rotations of the control member.

In the second operating condition, the level of the electric current absorbed by the electric motor 23 must be low for preventing the battery and the discharge thereof to be affected, since the low speeds do not allow the propelling motor to correctly recharge it.

For example the second operating condition is typical of boats when are intended for fishing. By travelling at a low speed, the propelling motor in idle mode charges the battery for low current values ranging from 25 to 15 Ampere, too few for supplying servo-assisted steering systems known in the prior art that arrive to consume higher values, about 60 Ampere.

If the operator has to make a manoeuvre, the control unit 24, according to the modes described above, detects a higher pressure request, therefore it temporarily sets the operation of the electric motor 23 such to increase the number of revolutions to guarantee the greatest servo-assistance, which is the maximum pressure level that can be obtained for performing any manoeuvres.

During the third operating condition it occurs similarly. The third operating condition provides a rapid sequence of manoeuvres, therefore for most of the time the operation of the electric motor 23 is set such to increase the number of revolutions to guarantee the greatest servo-assistance, which is the maximum pressure level that can be obtained.

Even when in the first operating condition an increase of the servo-assistance is requested, which requires an increase of the absorption electric current not provided in the first condition, the control unit 24 acts on the operation of the electric motor 23 in order to meet such requirement.

As already described above, the transition from an operating condition to another one is temporaneous, it is possible to set a time period, during which if there are no other requests of pressure increase, that is if the electric motor 23 is not asked to increase the power, then the control unit sets again the manually set operating condition.

According to an improvement of the device object of the present invention, in the case the operator manually selects the third operating condition, it is possible for the control unit 24 to set the electric motor 23 such that it runs with a lowest number of revolutions, if it does not receive from the control member 11, for a predetermined period of time, requests for increasing the servo-assistance.

According to an embodiment of the steering device object of the present invention, the control unit 24 can be controlled even manually.

Therefore the operator can manually set through the input unit 25 the operating condition and then can decide to temporaneously change the operating condition by manually setting the control unit.

Figure 2:
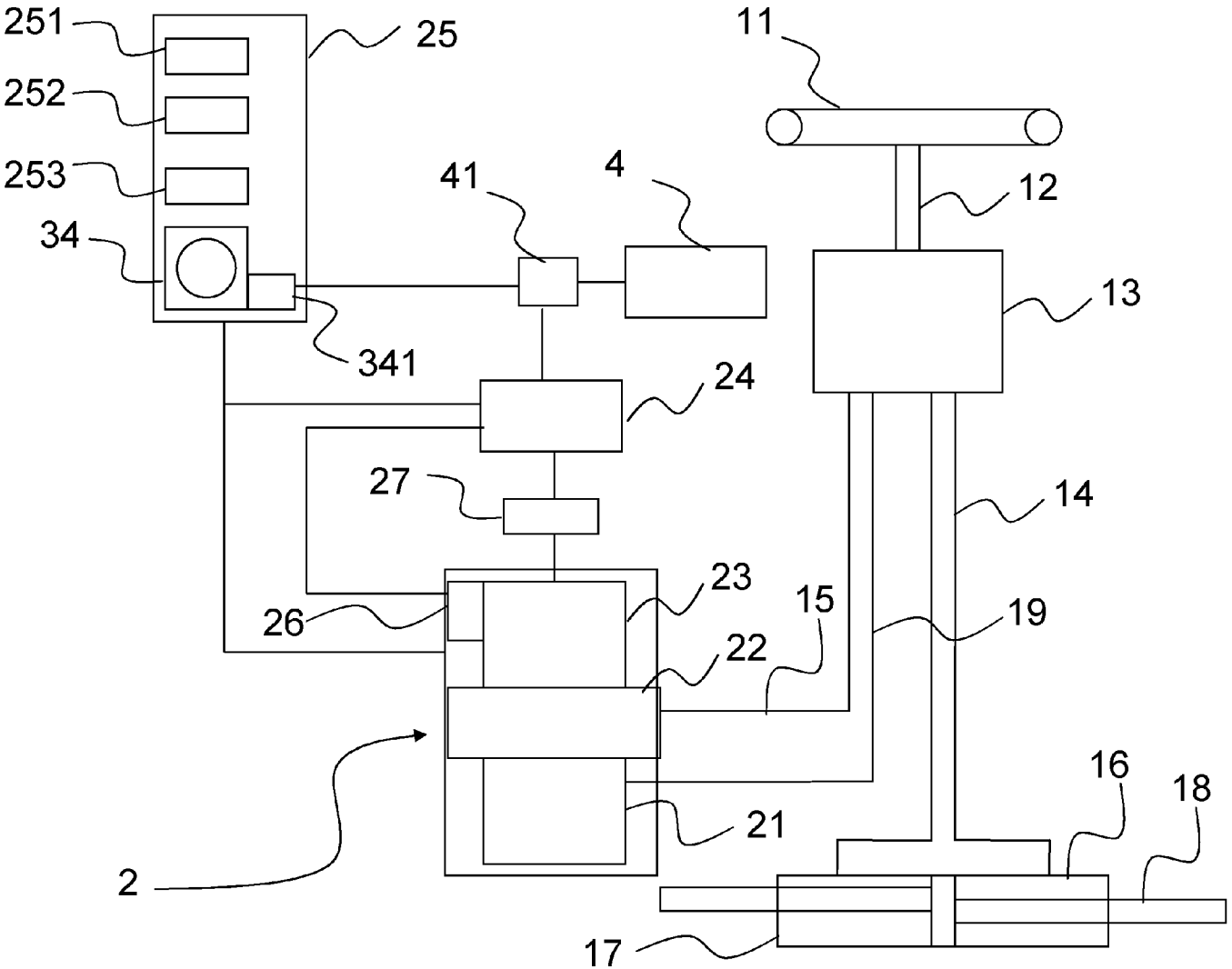
FIG. 2 is a schematic diagram of a further possible embodiment of the servo-assisted steering device object of the present invention.

FIG. 2 shows a schematic diagram of a further embodiment of the steering device object of the present invention.

Such embodiment has all the characteristics and operations described up to now and it has further improvements.

According to such embodiment it is possible to provide an input unit 25 connected to the control unit 24, for turning on/off the control unit 24.

Moreover, FIG. 2 shows and specifies the power supply means of the whole device object of the present invention, which are composed of a power generating and storing source, of the battery type or the like, and of circuits matching and connecting the battery 4 to the control unit 24 and to the hydraulic power unit 2, as well as to the input unit 25.

The circuits matching and connecting the battery 4 to the control unit 24 and to the hydraulic power unit 2 are opened and closed by a manually operated cut-off device 41.

The turning on/off of the control unit 24 by the input unit 25 is allowed since the input unit 25 comprises means for operating/disabling the control unit 24, which are composed of a push button switch 34, placed between the cut-off device 41 and the control unit 24.

The push button switch 34 has two conditions, of which an operating condition and a disabling condition, such that the control unit 24 is operated/disabled on the basis of the operating condition and disabling condition respectively of the push button switch 34. The push button 34 passes from the operating condition to the disabling condition by means of a manual control, but its operation is such that the disabling condition is automatically restored when the electronic control unit 341 detects a power interruption by the cut-off device.

It is possible to provide the battery 4 to supply, through the cut-off device 41 directly the control unit 24 not through the input unit 25.

In order to guarantee the operation described above it is possible to provide the electronics 341 of the intelligent push button 34 to be provided within the control unit 24.

Similarly, even the input unit can be provided connected only to the control unit 24, for setting it, or connected both to the control unit 24 and to the hydraulic power unit 2. In the first case the settings of the operating conditions of the electric motor 23 will be transmitted from the control unit 24 to the hydraulic power unit 2.

Moreover, the input unit 25 has three buttons 251, 252 and 253 allowing three different operating conditions of the electric motor 23 to be set, by means of the electric connection of the input unit 25 to the hydraulic power unit 2.

The three operating conditions settable by the input unit 25 all have the characteristics of the three operating conditions described up to now.

Moreover, there is provided a monitoring control unit 26, intended for monitoring the temperature of the electric motor 23 and which controls the means opening the power supply circuit of the electric motor 23.

The operation of such opening means is such that they automatically close and/or open the power supply circuit to the electric motor 23 depending on the overcoming of a predetermined maximum threshold temperature.

Within the monitoring control unit 26 therefore a temperature threshold value is stored which is variable and settable by the operator and when such value is exceeded, the power supply to the electric motor 23 is stopped.

According to an embodiment such interruption can pass through the control unit 24, since the monitoring unit 26 is electrically connected to the control unit 24, it notifies the threshold temperature being exceeded to the control unit which stops the supply of electric energy to the electric motor 23 with which it is connected.

It is further possible to provide in combination with the monitoring control unit 26, inside it or connected thereto, an acoustic and/or visual signaller which emits warning signals once the temperature of the electric motor or inside the space housing it reaches the set threshold temperature value.

According to a variant embodiment it is possible to provide the input unit 25 to comprise a display with signalling means which are separate for each provided operating conditions and input means for manually setting one of the provided operating conditions, which signalling means and which manual input means are connected to the control unit 24 for sending the command selecting the operating condition to the control unit 24 and for actuating the signalling means by the control unit 24, while upon the temporary automatic change of the operating condition of the electric motor 23 by the control unit 24 depending on the operating condition of the motor and particularly on the current absorbed by it, the control unit 24 keeps the means signalling the operating condition corresponding to the operating condition manually set by the setting input means in the activated condition.

Advantageously, there are associated means indicating the temperature of the motor and/or of the space housing it, and particularly indicating the overcoming of the maximum allowed threshold temperature and actuating the means opening the power supply circuit of the motor.

While the invention has been described in connection with the above described embodiments, it is not intended to limit the scope of the invention to the particular forms set forth, but on the contrary, it is intended to cover such alternatives, modifications, and equivalents as may be included within the scope of the invention. Further, the scope of the present invention fully encompasses other embodiments that may become apparent to those skilled in the art and the scope of the present invention is limited only by the appended claims.

The invention claimed is:

1. A servo-assisted steering device for vehicles comprising:

a manual control member;

a shaft (12) connected to the control member, a pressurized control fluid supplying and conveying unit (13) driven by the shaft when the control member (11) is rotated;

at least two fluid conveying lines connected to the supplying and conveying unit, pressurized fluid flowing through the conveying lines in and out of the supplying and conveying unit depending on a rotational direction of the shaft, the conveying lines being further connected to one of two chambers (16, 17) of a steering actuator (18) and comprising hydraulic pipes (14) for supplying the pressurized fluid alternately to one or the other of the two chambers (16, 17) of the actuator (18) depending on the rotational direction of the control member; and a hydraulic power unit (2) connected to the supplying and conveying unit (13) with a fluid supplying and conveying circuit, the hydraulic power unit comprising a reservoir (21) for the pressurized fluid and powered pumping means (22) driven by an electric motor (23) and by electrical connection means of the electric motor (23), the pumping means connected to the fluid supplying and conveying circuit and supplying the pressurized fluid alternately to the one or the other of the two chambers (16, 17) of the actuator (18) depending on the rotational direction of the control member (11), wherein the electric motor (23) is energized or de-energized upon operation of the control member (11), such that the pumping means (22) increase an amount of pumped fluid and increase a pressure exerted by the supplying and conveying unit (13) to reduce resistance upon a steering of the control member, wherein the hydraulic power unit (2) is connected to a control unit (24) and is operatively communicating with the electric motor (23) and the control member (11), the control unit (24) setting operation of the electric motor (23) depending on rate or number of rotations of the control member (11), wherein the electric motor (23) has a plurality of operating conditions, which are different from one another depending on a number of revolutions of the electric motor (23) or of the amount of fluid required by the control member (11) corresponding to typical mean operating modes of the control member under a plurality of travel conditions, the operating conditions being settable in alternating mode from one to another, wherein the operating conditions are manually settable by an operator with an input unit (25) connected to the electric motor (23), the input unit changing settings driving the electric motor (23) according to the number of revolutions thereof, imposing a limit to a power of a power signal, and wherein three different operating conditions are provided.

2. The servo-assisted steering device according to claim 1, wherein the control unit (24) sets electric current consumption of the electric motor (23) depending on the rate or number of rotations of the control member.

3. The servo-assisted steering device according to claim 1, wherein the control unit (24) detects, continuously, electric current consumption of the electric motor (23), compares the detected electric current consumption with the rate or number of rotations of the control member (11) and sets the operation of the electric motor (23), such that the electric current consumption of the electric motor (23) corresponds to the operation of the pumping means (22) to increase the amount of pumped fluid by increasing the pressure exerted by the supplying and conveying manual unit (13), such to reduce the resistance when steering the manual control means (11).

4. The servo-assisted steering device according to claim 1, wherein the input unit (25) has a display with signalling means which are separate for each provided operating condition and input means for manually setting one of the provided operating conditions, the signalling means and the input means being connected to the control unit (24) for sending a command selecting an operating condition to the control unit (24) and for actuating the signalling means by the control unit (24), wherein, upon a temporary automatic change of the operating condition of the motor (23) by the control unit (24) depending on the operating condition of the motor, the control unit (24) keeps the means signalling the operating condition corresponding to the operating condition manually set by the setting input means in an activated condition.

5. The servo-assisted steering device according to claim 1, wherein transition from one to another of the operating conditions is controlled by the control unit (24).

6. The servo-assisted steering device according to claim 5, wherein transition from one to another of the operating conditions is automatically controlled by the control unit (24), depending on the rate or number of rotations of the control member (11), the operating condition of the motor being detected.

7. The servo-assisted steering device according to claim 6, wherein the operating condition is detected by measuring current absorbed by the electric motor (27), the control unit (24) receiving a measured value of the absorbed current and automatically modifying a power limit value of a power signal fed to the electric motor, depending on the measured value of the absorbed current when the measured value exceeds a predetermined threshold or does not fall within a predetermined range of values, and wherein the predetermined threshold or the predetermined range of values is provided and stored for each provided operating condition.

8. The servo-assisted steering device according to claim 7, wherein the electric motor (23) automatically passes from one operating condition to another operating condition controlled by the control unit (24), and wherein the control unit (24), after a predetermined period of time, restores the electric motor to a previously manually set operating condition, the value of the absorbed current having returned back during the predetermined period of time and remained within value limits provided for the manually set operating condition.

9. The servo-assisted steering device according to claim 1, wherein the control unit is manually operable.

10. The servo-assisted steering device according to claim 1, further comprising a monitoring control unit (26) monitoring temperature of the electric motor (23), the monitoring control unit (26) controlling opening means for a power supply circuit of the electric motor (23), the opening means automatically closing or opening the power supply circuit of the electric motor depending on whether a predetermined maximum threshold temperature is exceeded.

11. The servo-assisted steering device according to claim 10, wherein the monitoring control unit (26) is electronically connected to the control unit (24).

12. The servo-assisted steering device according to claim 10, further comprising means operatively coupled to the monitoring control unit and indicating the temperature of the motor and whether a maximum available threshold temperature has been exceeded, and actuating the means opening the power supply circuit of the motor.

13. The servo-assisted steering device according to claim 1, wherein the supplying and conveying unit (13) comprises a hydraulic pump having a drive shaft connected to the manual control member of a hydraulic steering gear for steering a vehicle.

14. A servo-assisted steering device for boats or the like comprising:

a manual control member;

a shaft connected to the control member;

a pressurized control fluid supplying and conveying unit (13) driven by the shaft when the control member (11) is rotated;

at least two fluid conveying lines connected to the supplying and conveying unit, pressurized fluid flowing through the conveying lines in or out depending on a rotational direction of the shaft, the conveying lines being further connected to one of two chambers (16, 17) of a steering actuator (18) and comprising hydraulic pipes (14) for supplying the pressurized fluid alternately to one or the other of the two chambers (16, 17) of the actuator (18) depending on rotational direction of the control member (11); and a hydraulic power unit (2) connected to the supplying and conveying unit (13) with a fluid supplying and conveying circuit, the hydraulic power unit comprising a reservoir (21) for the pressurized fluid of powered pumping means (22) driven by an electric motor (23) and by electrical connection means of the electric motor (23), the pumping means being connected to the fluid supplying and conveying circuit for supplying the pressurized fluid alternately to one or the other of the two chambers (16, 17) of the actuator (18) depending on the rotational direction of the control member (11), wherein the electric motor (23) is energized or de-energized upon operation of the control member (11), such that the pumping means (22) increase an amount of pumped fluid and increase a pressure exerted by the supplying and conveying unit (13) to reduce resistance upon a steering the control member, and wherein the electric motor (23) of the hydraulic power unit (2) is fed by a voltage ranging from 12 V to 17 V.

15. The servo-assisted steering device according to claim 14, wherein the electric motor (23) of the hydraulic power unit (2) has a current absorption ranging from 0.5 to 40 A.

16. The servo-assisted steering device according to claim 14, wherein the electric motor (23) of the hydraulic power unit (2) provides less than 1500 revolutions/minute.

17. The servo-assisted steering device according to claim 14, wherein the pumping means (22) of the hydraulic power unit (2) provide pressures ranging from 1 bar to 42 bar.

18. The servo-assisted steering device according to claim 14, wherein the hydraulic power unit (2) is connected to a control unit (24) and is operatively communicating with the electric motor (23) and the control member (11), the control unit (24) setting operation of the electric motor (23) depending on rate or number of rotations of the control member (11).

19. A servo-assisted steering device for vehicles comprising:

a manual control member (11);

a shaft connected to the control member (12);

a pressurized control fluid supplying and conveying unit (13) driven by the shaft when the control member (11) is rotated;

at least two fluid conveying lines connected to the supplying and conveying unit, pressurized fluid flowing through the conveying lines in or out of the supplying and conveying unit depending on a rotational direction of the shaft, the conveying lines being further connected to one of two chambers (16, 17) of a steering actuator (18) and comprising hydraulic pipes (14) for supplying the pressurized fluid alternately to one or the other of the two chambers (16, 17) of the actuator (18) depending on the rotational direction of the control member; and a hydraulic power unit (2) connected to the supplying and conveying unit (13) with a fluid supplying and conveying circuit, the hydraulic power unit comprising a reservoir (21) for the pressurized fluid and powered pumping means (22) driven by an electric motor (23), and by electrical connection means of the electric motor (23), the pumping means being connected to the fluid supplying and conveying circuit and supplying the pressurized fluid alternately to one or the other of the two chambers (16, 17) of the actuator (18) depending on the rotational direction of the shaft (11) and correspondingly to the rotational direction of the control member (11), wherein the electric motor (23) is energized or de-energized upon operation of the control member (11), such that the pumping means (22) increase an amount of pumped fluid and increase a pressure exerted by the supplying and conveying manual unit (13) to reduce resistance upon a steering the control member, and wherein the hydraulic power unit (2) is connected to a control unit (24) in communication with the electric motor (23) and the control member (11), the control unit (24) setting operation of the electric motor (23) depending on rate or number of rotations of the control member (11); and wherein an input unit (25) is connected to the control unit (24) and turns on/off the control unit (24).

20. The servo-assisted according to claim 19, further comprising:

power supply means comprising a power generating and storing source and a circuit operatively connecting the source (4) to the control unit (24) and to the hydraulic power unit (2); and a manually operated cut-off device (41) configured to open or close the circuit operatively connecting the source (4) to the control unit (24) and to the hydraulic power unit (2).

21. The servo-assisted according to claim 19, wherein the input unit (25) comprises means for operating/disabling the control unit (24), the means for operating/disabling comprising a push button (34) having two conditions, a first condition being an operating condition and a second condition being a disabling condition, the input control unit (25) further comprising an electronic control unit (341), the push button (34) being placed between a cut-off device (41) and the control unit (24), the control unit (24) being operated or disabled depending on an operating/disabling condition of the push button (34).

22. The servo-assisted according to claim 21, wherein the push button (34) passes from the operating condition to the disabling condition with a manual control, the disabling condition of the push button (34) being automatically restored even without manual control when the electronic control unit (341) detects an interruption of power supply by the cut-off device (41).

* * * * *